United States Patent [19]

Moss

[11] 3,962,743

[45] June 15, 1976

[54] MOP AND METHOD OF MAKING SAME

[76] Inventor: Theron V. Moss, P.O. Box 234, Cleveland, Tenn. 37311

[22] Filed: June 27, 1974

[21] Appl. No.: 483,536

[52] U.S. Cl. ..... 15/229 AP; 300/21

[51] Int. Cl.[2] ..... A47L 13/20

[58] Field of Search..... 15/147, 226, 228, 229 R, 15/229 A, 229 AC, 229 AP, 229 B, 229 BC, 229 BP, 120 A; 300/21

[56] References Cited

UNITED STATES PATENTS

| | | | |
|---|---|---|---|
| 528,730 | 11/1894 | Magoris | 300/21 |
| 1,542,108 | 6/1925 | Taylor | 300/21 X |
| 2,703,425 | 3/1955 | Podolak et al. | 15/229 BC |
| 3,449,784 | 6/1969 | Moss | 15/229 BP |
| 3,525,113 | 8/1970 | Leland | 15/229 AP |
| 3,564,635 | 2/1971 | Komai et al. | 15/147 C |
| 3,636,603 | 1/1972 | Moss et al. | 300/21 X |
| 3,711,885 | 1/1973 | Griffin | 15/229 AP |
| 3,822,435 | 7/1974 | Moss | 300/21 X |

FOREIGN PATENTS OR APPLICATIONS

| | | | |
|---|---|---|---|
| 1,262,201 | 4/1961 | France | 15/229 BP |
| 441,955 | 1/1936 | United Kingdom | 15/147 R |

*Primary Examiner*—Daniel Blum

*Attorney, Agent, or Firm*—Donnelly, Maky, Renner & Otto

[57] ABSTRACT

A dust mop and method of making same which includes a pair of fabric layers defining a flat generally rectangular support member having one or more rows of looped yarn secured thereto by stitching, with the looped ends of the yarn extending outwardly beyond the longitudinal edges of the support member. The back fabric layer may have spaced-apart transverse slits therein to facilitate mounting the mop on a mop holder. In one form of the invention, a single row of looped yarn is secured to the support member by transversely spaced-apart stitching rows, with the looped ends of the yarn extending outwardly beyond the opposite longitudinal edges of the support member. The strands of yarn between the stitching rows preferably either have a length greater than the straight line distance between such stitching rows so that those strands hang down away from the support member during use of the mop, or the strands of yarn between such stitching rows are cut to provide free yarn ends. In another form of the invention, separate and distinct rows of looped yarn are stitched to the support member along both longitudinal edges thereof, and the remainder of the support member intermediate the rows of looped yarn is desirably covered by plural longitudinally extending cords of yarn running substantially the full length of the support member.

15 Claims, 11 Drawing Figures

MOP AND METHOD OF MAKING SAME

BACKGROUND OF THE INVENTION

This application relates to certain improvements in dust mops and is generally of the type disclosed in copending U.S. Pat. Application Ser. No. 317,538, filed Dec. 22, 1972, now U.S. Pat. No. 3,822,435, granted July 9, 1974, the disclosure of which is hereby incorporated herein by reference.

The mop described in the aforementioned copending application includes a support member with plural rows of yarn stitched thereto and transversely-spaced slits in the back fabric layer of the support member to facilitate mounting the mop to a mop holder.

Other dust mop constructions of the applicant herein, Mr. Theron V. Moss, are disclosed in U.S. Pat. No. 3,425,085, issued Feb. 4, 1969, and No. 3,531,815, issued Oct. 6, 1970.

SUMMARY OF THE INVENTION

The dust mop of the present invention is manufactured by stitching one or more rows of looped yarn to a fabric support member, with the looped ends of the yarn extending outwardly beyond the longitudinal edges of the support member.

In accordance with one arrangement, the support member consists of a double fabric layer on which a single row of yarn is laid. Stitching is then applied through the yarn and double fabric layer adjacent the opposite longitudinal edges of the support member for securing the yarn row against one of the fabric layers. Spaced-apart transverse slits may also be provided in the other fabric layer to facilitate mounting the mop to a mop holder. The looped ends of the yarn desirably extend outwardly a substantial distance beyond the edges of the support member and the stitching, and sufficient slack may be provided in the yarn strands extending between the stitching rows to permit the yarn strands to hang slightly downwardly from the one fabric layer during use of the mop.

In accordance with another arrangement, a single row of yarn is applied to a support member in the manner previously described, and the yarn strands between the stitching rows are then cut to provide free yarn ends. The resulting mop is one having two rows of yarn, each having looped ends extending outwardly from such stitching rows beyond the outer edges of the support member and free ends extending inwardly from such stitching rows.

In accordance with still another arrangement, separate and distinct rows of looped yarn are stitched to the support member along both longitudinal edges thereof, and the remainder of the support member intermediate the rows of looped yarn is covered by plural longitudinally extending cords of yarn running substantially the full length of the support member. The plural longitudinally extending cords of yarn are disposed in closely spaced parallel relation to each other to completely cover the bottom fabric layer intermediate the outer rows of looped yarn and are secured thereto by a row of stitching which generally crisscrosses the longitudinally extending cords along the length thereof. The longitudinally extending cords are desirably only sewn to the bottom layer of fabric, whereas the stitching for the outer rows of looped yarn desirably extends through both fabric layers.

With the foregoing in mind, it is a principal object of the present invention to provide an improved dust mop and method of making same.

Another object is to provide an improved mop and method of making same by using one or more rows of looped yarn while providing a substantial width to the mop.

A further object is to provide a mop and method of making same by using one or more rows of looped yarn and providing a double fabric layer in a back support member so that spaced transverse slits in the back fabric layer may be formed to provide pockets for mounting the mop on a mop holder.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
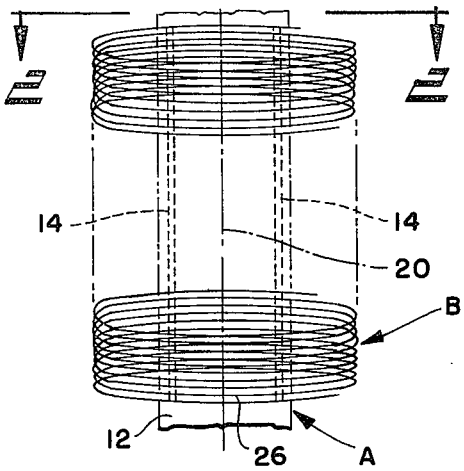
FIG. 1 is a fragmentary bottom plan view looking down on one form of mop during manufacture in accordance with the present invention.
Figure 2:
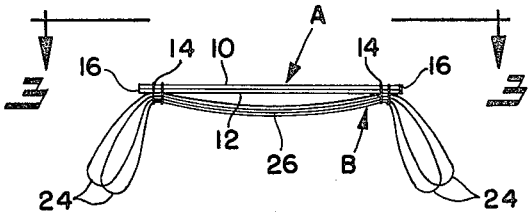
FIG. 2 is an end elevational view looking generally in the direction of arrows 2—2 of FIG. 1 and showing the position of yarn when the mop is mounted on a mop holder in a position of use.

Referring now to the drawing, wherein the showings are for purposes of illustrating certain preferred embodiments of the invention only and not for purposes of limiting same, FIG. 1 shows a fabric-type of support member A which may consist of two individual fabric layers 10 and 12 as shown in FIG. 2. Such fabric layers 10 and 12 may be formed of any suitable fabric material including cloth, paper or plastic, or composites thereof. Such fabric layers may be in the form of coils located adjacent a moving conveyor or the like for uncoiling of such layers in longitudinally aligned stacked relationship to one another on the conveyor.

As fabric support member A travels along with the conveyor, a single continuous row of looped yarn B is laid down thereon against fabric layer 12. Row B of looped yarn may be formed by wrapping the yarn in spiral fashion around the outer runs of a pair of endless conveyor chains as shown and described, for example, in U.S. Pat. No. 3,696,460, or may be laid down by a traversing loop roller type of mechanism which moves back and forth transversely of support member A to deposit overlapping coils thereon. A sewing operation then applies one or more rows of stitching as at 14 through yarn row B and one or both of fabric layers 10 and 12 adjacent both edges of the fabric support member for holding yarn row B generally against fabric layer 12. Support member A may then be cut into predetermined lengths so that in the finished mop shown in FIG. 3 support member A is flat and generally rectangular, having opposite longitudinal edges 16, opposite end edges 18 and a longitudinal axis 20. Longitudinally spaced-apart transverse slits 22 may be formed in fabric layer 10 between stitching rows 14 to define pockets between fabric layers 10 and 12 for receiving extensions on a mop holder. Longitudinal slits may also be provided in fabric layer 10 extending from transverse slits 22 toward end edges 18 and ties may be sewn adjacent such longitudinal slits for an alternative mounting arrangement.

Figure 3:
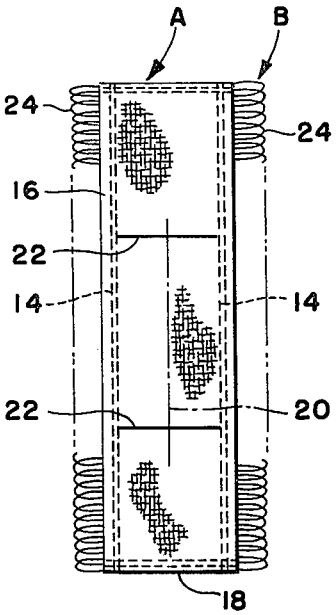
FIG. 3 is a fragmentary top plan view looking generally in the direction of arrows 3—3 of FIG. 2.

The row of yarn B is preferably laid down on support member A in such a manner that looped ends 24 thereof extend outwardly a substantial distance beyond the outer stitching rows 14 and opposite longitudinal edges 16, for example 3 to 3½ inches, as shown in FIG. 2. Moreover, the stitching rows 14 are desirably located fairly close to the longitudinal edges 16 of the support member A, for example, approximately ¼ inch in from such edges, and the spacing between the inside rows of stitching 14 is desirably approximately 5½ to 6½ inches. The fabric support member A may be cut into any length desired, for example, 18 to 24 inches, after which both layers 10 and 12 of the support member are desirably stitched together across the entire width of the mop at both ends as shown in FIG. 3. However, it will be apparent that the fabric support member may be cut into shorter lengths, for example, 8 to 10 inches long, and the two layers of fabric may be stitched together at one end only to permit insertion of a person's hand between the two fabric layers from the other end for use of the device as a polishing or scrubbing mit.

Due to the looping of yarn row B, the yarn strands 26 extending between stitching rows 14 may also be made longer than the straight line distance between such stitching rows to provide sufficient slack so that such intermediate yarn strands hang downwardly from fabric layer 12 during use of the mop as shown in FIG. 2.

Figure 4:
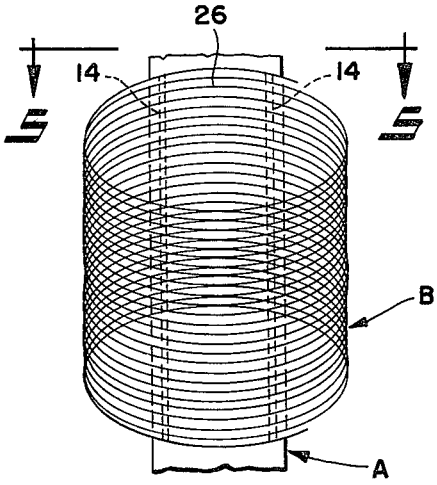
FIG. 4 is a plan view similar to FIG. 1 showing the loops more loosely wound.
Figure 5:
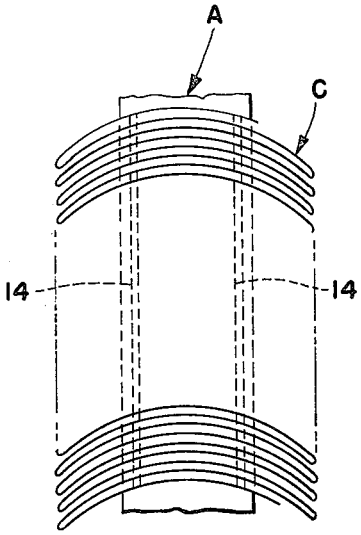
FIG. 5 is a plan view similar to FIGS. 1 and 4 and showing another yarn looping arrangement.

FIG. 4 shows an arrangement wherein the yarn row is formed with larger loops in order that intermediate yarns 26 extending between stitching rows 14 will be substantially longer than the straight line distance between such stitching rows for increased slack in order that such intermediate yarn strands may hang down from the bottom fabric layer 12 a greater distance than that shown in FIG. 2. FIG. 5 shows an arrangement wherein yarn row C is looped in an arcuately curved manner instead of in coils to illustrate another way of obtaining a greater length for the intermediate yarn strands between stitching rows 14. Obviously, many other arrangements may be provided for having the intermediate yarn strands hang down varying distances from fabric layer 12. Some slack in the intermediate yarn strands is desirable both to facilitate picking up of dust and shaking the dust mop out. However, it is apparent that such slack could be substantially eliminated if desired and the mop could still be used for its intended function.

Figure 6:
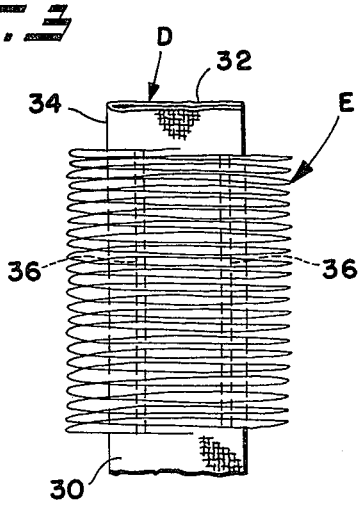
FIG. 6 is a plan view showing another form of mop during manufacture.
Figure 7:
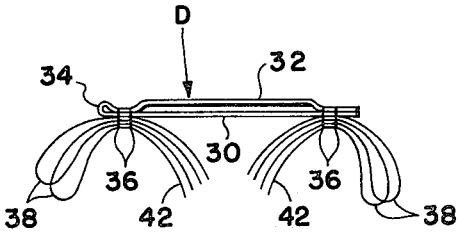
FIG. 7 is an end elevational view showing a completed mop constructed in accordance with the procedure of FIG. 6.
Figure 8:
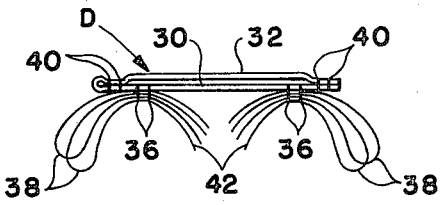
FIG. 8 is an end elevational view showing another form of mop in accordance with the present invention.
Figure 11:
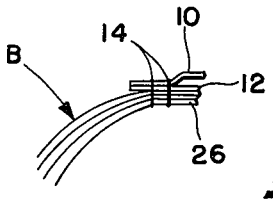
FIG. 11 is a fragmentary end elevational view of still another form of mop manufactured in accordance with the present invention.

FIG. 6 shows another method of making a mop in accordance with this invention wherein a fabric support member D twice as wide as the desired finished mop is used so that it includes sections 30 and 32 on opposite sides of a crease center line 34. Support member D is desirably first folded along the crease center line and then advanced by a moving conveyor while a continuous single row of looped yarn E is laid down on section 30, with the longitudinal center line of yarn row E generally corresponding with the longitudinal center line of section 30. One or more rows of stitching 36 are then preferably extended through yarn row E and both fabric sections 30 and 32 slightly inwardly from the outer edges of both fabric sections and the crease line 34. Transverse slits may be formed in section 32 in the manner previously described to facilitate mounting the mop to a mop holder. If the transverse slits to be formed are wider than the spacing between the outer rows of stitching 36, then the looped yarn E may be stitched to the bottom fabric section 30 only prior to folding the fabric support member D, followed by the folding and stitching of the folded fabric support member along the crease line and outer edges as shown at 40 in FIG. 8. In the form of the invention shown in FIGS. 7 and 8, the intermediate yarns extending between stitching 36 are then desirably centrally severed to provide free yarn ends 42. The completed mop thus ultimately includes a pair of yarn rows, with each yarn row being formed from a plurality of generally U-shaped yarn strands each having looped ends 38 and free ends 42. Looped ends 38 extend outwardly from stitching 36, while free ends 42 extend inwardly and toward one another from such stitching. It will of course be recognized that the mop described with respect to FIGS. 1–5 may also have the intermediate yarns between the stitching rows centrally severed if desired to provide free yarn ends as described with respect to FIGS. 7 and 8, and the outer loops may also be subsequently cut as shown, for example, in FIG. 11. It will also be recognized that the support members for the mops of FIGS. 6–8 may be made from two individual pieces of fabric as in the FIGS. 1–5 embodiments rather than a single piece folded over, and vice versa.

Figure 9:
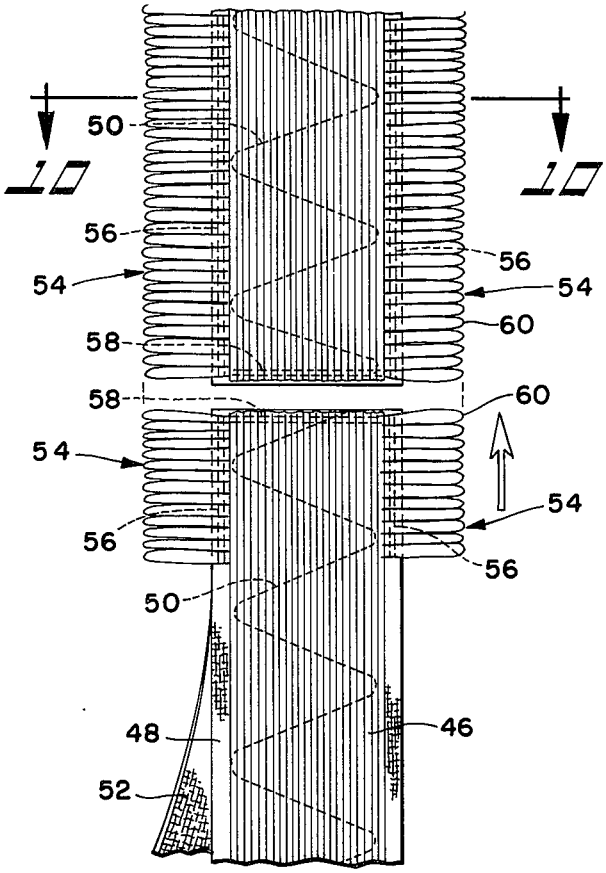
FIG. 9 is a plan view showing yet another form of mop during manufacture.
Figure 10:
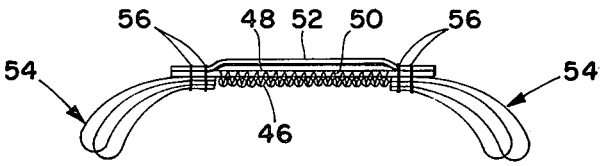
FIG. 10 is a transverse section through the mop of FIG. 9, taken on the plane of the line 10—10 thereof.

In FIG. 9 there is shown still another method of making a mop in accordance with this invention wherein a plurality of longitudinally extending cords 46 are laid down on a bottom layer of fabric 48 and secured thereto as by stitching 50 extending through the longitudinally extending cords and bottom layer of fabric in a zig zag pattern as illustrated. The longitudinally extending cords 46 are desirably placed in side-by-side relation with no gaps therebetween as shown in FIG. 10 so as to avoid streaking during use of the mop, and while only one layer of such longitudinally extending cords 46 is shown, it will be appreciated that more than one layer of cords may be provided on the bottom layer of fabric 48 if desired.

After the longitudinally extending cords 46 have been secured to the bottom layer of fabric 48, the back layer of fabric 52 and separate and distinct rows of looped yarn 54 may be secured to the bottom layer of fabric 48 by one or more rows of stitching 56 extending through the rows of looped yarn 54 and both layers of fabric. Afterwards, the mops may be cut to any desired length and the ends of the mop may be stitched at 58 across the full width of the mop to prevent unraveling as further shown in FIG. 9. Finally, transverse slits may be formed in the back layer of fabric 52 in the manner previously described to facilitate mounting the mop to a mop holder.

With such a mop construction, there are no gaps between the longitudinally extending cords of yarn which might cause streaking by the mop during use. Moreover, because the mop cords 46 extend longitudinally of the mop, during use of the mop, the mop is pushed in a direction transversely of the longitudinally extending mop cords, resulting in a more effective use of the mop cords 46 in picking up dust and the like.

While the mop cords 46 are shown fairly tightly held against the bottom layer of fabric 48 by the stitching 50, it will be appreciated that some slack may be provided in the mop cords 46 between the regions where the stitching 50 extends back and forth across the width of the mop. Moreover, it will also be appreciated that the outer loops 60 of the mop of the FIGS. 9 and 10 embodiment may also be subsequently cut as shown, for example, in FIG. 11, if desired.

Although the invention of the present application has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

I claim:

1. A dust mop comprising a pair of fabric layers defining a flat generally rectangular support member having opposite longitudinal edges, opposite end edges and a longitudinal axis, a row of looped yarn adjacent one side of said support member and having looped ends extending outwardly beyond said longitudinal edges, outer rows of stitching extending through said yarn and at least one of said fabric layers adjacent said longitudinal edges for attaching said yarn to said support member, said yarn between said outer stitching rows being free from attachment to said support member, and the other of said fabric layers including means to facilitate mounting said mop to a mop holder.

2. The dust mop of claim 1 wherein the strands of said yarn between said stitching have a length greater than the straight line distance between such stitching so that said strands hang down away from said one fabric layer during use of said mop.

3. The dust mop of claim 1 wherein said row of looped yarn has a predetermined width and said looped ends extend outwardly of said stitching approximately one-fourth of such width.

4. The dust mop of claim 1 wherein said outer rows of stitching extend only through said yarn and said one fabric layer for securing said yarn to said one fabric layer, and said fabric layers are secured together by additional stitching extending only through said fabric layers outwardly of said outer rows of stitching.

5. A dust mop comprising a flat generally rectangular support member having opposite longitudinal edges, a row of looped yarn extending substantially the full length of said support member adjacent one side thereof and having looped ends extending outwardly beyond said longitudinal edges, said row of looped yarn being secured to said support member by outer rows of stitching only adjacent said longitudinal edges, the strands of said yarn between said outer rows of stitching being free from attachment to said support member and having a greater width than the straight line distance between said stitching so that said strands hang down away from said support member during use of said mop.

6. A method of manufacturing a dust mop comprising the steps of laying down on top of one another a pair of individual fabric pieces with their longitudinal edges aligned, laying down on one of such fabric pieces on the side opposite the other fabric piece a row of looped yarn having looped ends extending outwardly beyond such longitudinal edges and stitching through such yarn and fabric pieces only adjacent such longitudinal edges so that the yarn between such stitching is free from attachment to such fabric pieces, during the step of laying down such row of looped yarn, sufficient slack be provided in the yarn extending across the fabric so that the yarn strands between the stitching are longer than the straight line distance between such stitching, whereby such yarn strands between the stitching will hang down away from such one fabric piece during use of the mop.

7. A method of manufacturing a dust mop comprising the steps of laying down on top of one another a pair of individual fabric pieces with their longitudinal edges aligned, laying down on one of such fabric pieces on the side opposite the other fabric piece a row of looped yarn having looped ends extending outwardly beyond such longitudinal edges and stitching through such yarn and fabric pieces only adjacent such longitudinal edges so that the yarn between such stitching is free from attachment to such fabric pieces, and cutting the yarn strands intermediate the stitching.

8. A dust mop comprising a flat generally rectangular fabric support member having opposite longitudinal edges, a pair of yarn rows stitched to said support member, each said row including a plurality of individual generally U-shaped strands having looped ends and a pair of free ends, said looped ends of said strands in each row extending outwardly from the stitching beyond said longitudinal edges, and said pair of free ends of each said strand in each row extending inwardly toward one another from the stitching.

9. The dust mop of claim 8 wherein said support member comprises a pair of fabric layers and said yarn rows are stitched to one of such layers only, the other of said layers including means to facilitate mounting said mop to a mop holder.

10. The dust mop of claim 8 wherein each said yarn row is stitched to said support member by a pair of transversely-spaced stitching rows including inner stitching rows and outer stitching rows so that said strands in each row have intermediate portions spanning said stitching rows between said looped ends and free ends thereof.

11. The dust mop of claim 10 wherein said support member comprises a pair of fabric layers, said inner stitching rows extending through only one of said layers and said outer stitching rows extending through both of said layers.

12. A method of manufacturing a dust mop comprising the steps of laying down a flat fabric support member having opposite longitudinal edges, laying down on such support member a row of looped yarn having looped ends extending outwardly beyond such longitudinal edges, stitching such yarn to such support member only adjacent such longitudinal edges so that the yarn between such stitching is free from attachment to said support member, and severing such yarn intermediate such stitching rows to provide free yarn ends extending toward one another from such stitching rows.

13. A method of manufacturing a dust mop comprising the steps of laying down a flat fabric support member having opposite longitudinal edges, laying down on such support member a row of looped yarn having looped ends extending outwardly beyond such longitudinal edges, stitching such yarn to such support member only adjacent such longitudinal edges so that the yarn between such stitching is free from attachment to said support member, said steps of laying down such row of yarn and stitching same be carried out by laying such yarn down and stitching same to the front of a first fabric layer, and subsequently laying a second fabric layer on the back of such first fabric layer and stitching such fabric layers together.

14. The method of claim 13 further comprising the step of cutting at least some of such looped ends extending outwardly beyond such longitudinal edges.

15. The method of claim 13 wherein such first and second fabric layers are a single piece of material which is folded over along the longitudinal center line thereof after such yarn has been stitched to the first fabric layer.

* * * * *